US012721373B2

(12) United States Patent
Spratley et al.

(10) Patent No.: US 12,721,373 B2
(45) Date of Patent: Sep. 1, 2026

(54) AEROSOL PROVISION DEVICE

(71) Applicant: Nicoventures Trading Limited, London (GB)

(72) Inventors: Jon Peter Frederick Spratley, Cambridgeshire (GB); Francesca Alys Stephens, Cambridgeshire (GB); Adam Robinson, Cambridgeshire (GB); Simon James Copley, Cambridgeshire (GB); Daniel Jerrad Moss, Cambridgeshire (GB); Andy Finch, Cambridgeshire (GB)

(73) Assignee: Nicoventures Trading Limited, London (GB)

( * ) Notice: Subject to any disclaimer, the term of this patent is extended or adjusted under 35 U.S.C. 154(b) by 604 days.

(21) Appl. No.: 18/040,739

(22) PCT Filed: Aug. 4, 2021

(86) PCT No.: PCT/EP2021/071811
§ 371 (c)(1),
(2) Date: Feb. 6, 2023

(87) PCT Pub. No.: WO2022/029199
PCT Pub. Date: Feb. 10, 2022

(65) Prior Publication Data

US 2023/0292836 A1 Sep. 21, 2023

(30) Foreign Application Priority Data

Aug. 5, 2020 (GB) ..... 2012180

(51) Int. Cl.
*A24F 40/42* (2020.01)
*A24F 7/00* (2006.01)
(Continued)

(52) U.S. Cl.
CPC ..... *A24F 40/42* (2020.01); *A24F 7/00* (2013.01); *A24F 40/53* (2020.01)

(58) Field of Classification Search
None
See application file for complete search history.

(56) References Cited

U.S. PATENT DOCUMENTS

2007/0045288 A1* 3/2007 Nelson ..... A61M 11/041 219/533
2012/0240929 A1 9/2012 Steiner et al.
(Continued)

FOREIGN PATENT DOCUMENTS

CN 206482019 9/2017
CN 210492618 5/2020
(Continued)

OTHER PUBLICATIONS

International Search Report and Written Opinion received for PCT Patent Application No. PCT/EP2021/071811, mailed on Dec. 9, 2021, 13 pages.
(Continued)

*Primary Examiner* — Philip Y Louie
*Assistant Examiner* — Madeleine P Delacruz
(74) *Attorney, Agent, or Firm* — MERCHANT & GOULD P.C.

(57) ABSTRACT

The present application describes an aerosol provision device. The device has a chamber configured to receive a consumable including an aerosol-generating material, a body, and a mouthpiece through which aerosol generated is drawn by a user when the mouthpiece is arranged in an open position. The device is configured so that movement of the consumable towards or into the chamber causes the mouthpiece to move relative to the body from a closed position to the open position.

18 Claims, 7 Drawing Sheets

(51) Int. Cl.

| | |
|---|---|
| ***A24F 40/20*** | (2020.01) |
| ***A24F 40/40*** | (2020.01) |
| ***A24F 40/53*** | (2020.01) |

(56) References Cited

U.S. PATENT DOCUMENTS

| | | | | |
|---|---|---|---|---|
| 2015/0245668 | A1* | 9/2015 | Memari | A24F 40/95 206/250 |
| 2016/0050975 | A1* | 2/2016 | Worm | A45C 13/16 131/328 |
| 2018/0084832 | A1 | 3/2018 | Li et al. | |
| 2018/0338526 | A1 | 11/2018 | Ouyang et al. | |
| 2019/0208817 | A1 | 7/2019 | Weihua et al. | |
| 2022/0007727 | A1* | 1/2022 | Lee | A24F 40/42 |

FOREIGN PATENT DOCUMENTS

| | | | |
|---|---|---|---|
| WO | 2020/128074 | A1 | 6/2020 |
| WO | 2020148631 | | 7/2020 |

OTHER PUBLICATIONS

Japanese Notice of Reason for Rejection in Application No. 2024-095743, dated Mar. 17, 2026, 7 pages.

* cited by examiner

AEROSOL PROVISION DEVICE

PRIORITY CLAIM

The present application is a National Phase entry of PCT Application No. PCT/EP2021/071811, filed Aug. 4, 2021, which claims priority from GB Application No. 2012180.2, filed Aug. 5, 2020, each of which hereby fully incorporated herein by reference.

TECHNICAL FIELD

The present disclosure relates to aerosol provision devices, aerosol provision systems comprising an aerosol provision device, and methods of arranging an aerosol provision device.

BACKGROUND

Smoking articles such as cigarettes, cigars and the like, burn tobacco during use to create tobacco smoke. Attempts have been made to provide alternatives to these articles by creating products that release compounds without combusting. Examples of such products are so-called "heat not burn" products or tobacco heating devices or products, which release compounds by heating, but not burning, material. The material may be, for example, tobacco or other non-tobacco products, which may or may not contain nicotine.

SUMMARY

A first aspect provides an aerosol provision device. The aerosol provision device is for generating an inhalable medium. The aerosol provision device comprises a chamber configured to receive a consumable comprising aerosol-generating material. The aerosol provision device comprises a body. The aerosol provision device comprises a mouthpiece through which aerosol generated from the aerosol-generating material is drawn by a user of the aerosol provision device when the mouthpiece is arranged in an open position. The aerosol provision device is configured so that movement of the consumable towards or into the chamber causes the mouthpiece to move relative to the body from a closed position to the open position.

In some embodiments, the mouthpiece comprises a wall of the chamber.

In some embodiments, the body comprises at least a portion of the chamber.

In some embodiments, the aerosol provision device is configured so that, in the closed position, the mouthpiece is retracted in the body.

In some embodiments, the aerosol provision device is configured so that, in the open position, the mouthpiece is extended from the body.

In some embodiments, a direction of extension of the mouthpiece is the same as a direction of a majority dimension of the aerosol provision device.

In some embodiments, the chamber is at least partially unblocked when the mouthpiece is in the closed position.

In some embodiments, a size of the chamber is the same when the mouthpiece is in the closed position and the open position.

In some embodiments, a size of the chamber is different when the mouthpiece is in the closed position compared to when the mouthpiece is in the open position.

In some embodiments, the chamber has a first volume when the mouthpiece is in the closed position that is smaller than a second volume of the chamber when the mouthpiece is in the open position.

In some embodiments, the mouthpiece is configured to occupy at least a portion of the chamber in the closed position and block access by the consumable to the chamber.

In some embodiments, the aerosol provision device is configured so that insertion of the consumable towards or into the chamber causes the mouthpiece to move relative to the body.

In some embodiments, a position of the mouthpiece relative to the body is determined by a position of the consumable relative to the body.

In some embodiments, the mouthpiece is rotatable from the closed position to the open position.

In some embodiments, the mouthpiece is helically rotatable from the closed position to the open position.

In some embodiments, the mouthpiece is translationally moveable from the closed position to the open position.

In some embodiments, the mouthpiece is rectilinearly moveable from the closed position to the open position.

In some embodiments, the aerosol provision device comprises a guide configured to guide movement of the mouthpiece in a predetermined manner between the open position and the closed position. In some embodiments, the guide comprises a pivot. In some embodiments, the guide comprises a track and a runner configured to move along the track.

In some embodiments, the aerosol provision device comprises a detector to detect insertion of the consumable into or towards the chamber, and a controller to receive an output from the detector and cause the mouthpiece to move relative the body from the closed position to the open position on the basis of the output.

In some embodiments, the aerosol provision device comprises a driving mechanism configured to drive movement of the mouthpiece from the closed position to the open position.

In some embodiments, the aerosol provision device comprises a damping mechanism configured to control at least a portion of movement of the mouthpiece from the closed position to the open position.

In some embodiments, the chamber is configured to receive the consumable through a side of the aerosol provision device.

In some embodiments, the chamber is configured to receive the consumable through an end of the aerosol provision device.

In some embodiments, a direction of insertion of the consumable into the chamber is the same as a direction of movement of the mouthpiece from the closed position to the open position.

In some embodiments, a direction of insertion of the consumable into the chamber is different to a direction of movement of the mouthpiece between the open and closed positions. In some embodiments, the direction of insertion of the consumable into the chamber is perpendicular to the direction of movement of the mouthpiece between the open and closed positions.

In some embodiments, the aerosol provision device is arranged such that the consumable is visible to a user when the mouthpiece is in the open position and the consumable is located in the chamber.

In some embodiments, the aerosol provision device is arranged such that, when the consumable is located in the chamber, the consumable is visible to the user when looking at a longitudinal end of the aerosol provision device. In some embodiments, the aerosol provision device is arranged such that, when the consumable is located in the chamber, the consumable is concealed from the user when looking at a side of the aerosol provision device. In some embodiments, the aerosol provision device is arranged such that, when the consumable is located in the chamber, the consumable is concealed from the user when looking at any side of the aerosol provision device.

In some embodiments, the aerosol provision device is arranged such that, when the consumable is located in the chamber, the consumable is visible to the user when looking at a side of the aerosol provision device. In some embodiments, the aerosol provision device is arranged such that, when the consumable is located in the chamber, the consumable is concealed from the user when looking at a longitudinal end of the aerosol provision device. In some embodiments, the aerosol provision device is arranged such that, when the consumable is located in the chamber, the consumable is concealed from the user when looking at opposing longitudinal ends of the aerosol provision device.

In some embodiments, the aerosol provision device is arranged such that, when the consumable is located in the chamber, a portion of the consumable is visible to the user, wherein the portion comprises part of an overall dimension of the consumable. In some embodiments, the overall dimension is a length of the consumable. In some embodiments, the overall dimension is a width of the consumable. In some embodiments, the overall dimension is a depth of the consumable. In some embodiments, the part is less than or equal to 50% of the overall dimension. In some embodiments, the part is less than or equal to 25% of the overall dimension. In some embodiments, the part is less than or equal to 10% of the overall dimension. In some embodiments, the part is less than or equal to 1% of the overall dimension.

In some embodiments, the aerosol provision device is arranged such that, when the consumable is located in the chamber, the consumable is visible to the user without protruding from a surface of the aerosol provision device.

In some embodiments, the chamber is configured to conceal the consumable when the consumable is received in the chamber and when viewing the consumable in a direction perpendicular to a longitudinal axis of the consumable.

According to a second aspect, there is provided an aerosol provision system. The aerosol provision system comprises the aerosol provision device according to the first aspect and the consumable comprising aerosol-generating material.

According to a third aspect, there is provided a method of arranging an aerosol provision device. The method comprises providing a mouthpiece of the aerosol provision device in a position away from an open position, wherein aerosol generated from the aerosol-generating material can be drawn through the mouthpiece by a user of the aerosol provision device. The method comprises inserting a consumable into the aerosol provision device. The method comprises causing, by the inserting, the mouthpiece to move relative to the body to the open position so that the aerosol can be drawn through the mouthpiece by the user.

In some embodiments, the method is a method of arranging the aerosol provision device according to the first aspect.

Further features and advantages of the disclosure will become apparent from the following description of embodiments of the disclosure, given by way of example only, which is made with reference to the accompanying drawings.

BRIEF DESCRIPTION OF THE DRAWINGS

Embodiments of the disclosure will now be described, by way of example only, with reference to accompanying drawings, in which.

DETAILED DESCRIPTION

Figure 1A:
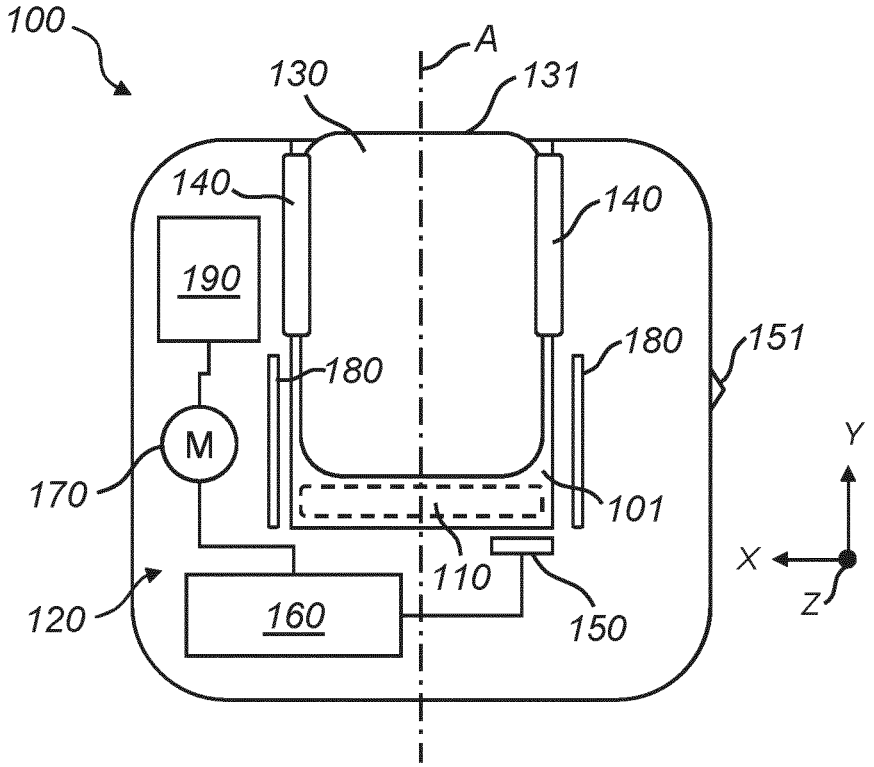
FIGS. 1*a* and 1*c* each show a schematic cross-sectional view of an aerosol provision device.

The present disclosure relates to aerosol provision devices, such as non-combustible aerosol provision devices, and to aerosol provision systems, such as non-combustible aerosol provision systems. According to the present disclosure, a "non-combustible" aerosol provision device is one where a constituent aerosol-generating material comprised by a consumable for receipt by a chamber of the aerosol provision device (or component thereof) is not combusted or burned in order to facilitate delivery of the aerosol-generating material to a user. In some embodiments, the aerosol provision system, such as the non-combustible aerosol provision system, comprises an aerosol provision device, such as a non-combustible aerosol provision device, and a consumable for use with the aerosol provision device, the consumable comprising an aerosol-generating material.

In some embodiments, the non-combustible aerosol provision system is a powered non-combustible aerosol provision system.

In some embodiments, the non-combustible aerosol provision system is an electronic cigarette, also known as a vaping device or electronic nicotine delivery system (END), although it is noted that the presence of nicotine in the aerosol-generating material is not a requirement.

In some embodiments, the non-combustible aerosol provision system is an aerosol-generating material heating system, also known as a heat-not-burn system. An example of such a system is a tobacco heating system.

In some embodiments, the non-combustible aerosol provision system is a hybrid system to generate aerosol using a combination of aerosol-generating materials, one or a plurality of which may be heated. Each of the aerosol-generating materials may be, for example, in the form of a solid, liquid or gel and may or may not contain nicotine. In some embodiments, the hybrid system comprises a liquid or gel aerosol-generating material and a solid aerosol-generating material. The solid aerosol-generating material may comprise, for example, tobacco or a non-tobacco product.

Aerosol-generating material is a material that is capable of generating aerosol, for example when heated, irradiated or energized in any other way. Aerosol-generating material may, for example, be in the form of a solid, liquid or gel which may or may not contain an active substance and/or flavorants. The aerosol-generating material may comprise an "amorphous solid", which may alternatively be referred to as a "monolithic solid" (i.e. non-fibrous). In some embodiments, the amorphous solid may be a dried gel. The amorphous solid is a solid material that may retain some fluid, such as liquid, within it. In some cases, the aerosol-generating material comprises from about 50 wt %, 60 wt % or 70 wt % of amorphous solid, to about 90 wt %, 95 wt % or 100 wt % of amorphous solid. In some cases, the aerosol-generating material consists of amorphous solid.

The aerosol-generating material may comprise one or more active substances and/or flavors, one or more aerosol-former materials, and optionally one or more other functional materials.

In some embodiments, a substance to be delivered by the aerosol provision device may be an aerosol-generating material which may comprise an active constituent, a carrier constituent and optionally one or more other functional constituents.

A consumable is an article comprising or consisting of aerosol-generating material, part or all of which is intended to be consumed during use by a user. A consumable may comprise one or more other components, such as an aerosol-generating material storage area, an aerosol-generating material transfer component, an aerosol generation area, a housing, a wrapper, a mouthpiece, a filter and/or an aerosol-modifying agent. A consumable may also comprise an aerosol generator, such as a heater, that emits heat to cause the aerosol-generating material to generate aerosol in use. The heater may, for example, comprise combustible material, a material heatable by electrical conduction, or a susceptor.

In some embodiments, the consumable for use with the aerosol provision device may comprise aerosol-generating material or an area for receiving aerosol-generating material. The area for receiving aerosol-generating material may be a storage area for storing aerosol-generating material. For example, the storage area may be a reservoir. In some embodiments, the area for receiving aerosol-generating material may be separate from, or combined with, an aerosol generating area.

A susceptor is a material that is heatable by penetration with a varying magnetic field, such as an alternating magnetic field. The susceptor may be an electrically-conductive material, so that penetration thereof with a varying magnetic field causes induction heating of the heating material. The heating material may be magnetic material, so that penetration thereof with a varying magnetic field causes magnetic hysteresis heating of the heating material. The susceptor may be both electrically-conductive and magnetic, so that the susceptor is heatable by both heating mechanisms. The device that is configured to generate the varying magnetic field is referred to as a magnetic field generator, herein.

In some embodiments, the non-combustible aerosol provision system, such as a non-combustible aerosol provision device thereof, may comprise a power source and a controller. The power source may, for example, be an electric power source or an exothermic power source. In some embodiments, the exothermic power source comprises a carbon substrate which may be energized so as to distribute power in the form of heat to an aerosol-generating material or to a heat transfer material in proximity to the exothermic power source.

In some embodiments, the non-combustible aerosol provision device may comprise an area for receiving the consumable, an aerosol generator, an aerosol generation area, a housing, a mouthpiece, a filter and/or an aerosol-modifying agent.

A user may insert the consumable into the aerosol provision device before an aerosol is produced, which the user subsequently inhales. The consumable may be, for example, of a predetermined or specific size that is configured to be placed within a chamber, such as a heating chamber, of the device which is sized to receive the consumable.

An aerosol-modifying agent is a substance, typically located downstream of the aerosol generation area, that is configured to modify the aerosol generated, for example by changing the taste, flavor, acidity or another characteristic of the aerosol. The aerosol-modifying agent may be provided in an aerosol-modifying agent release component, that is operable to selectively release the aerosol-modifying agent.

The aerosol-modifying agent may, for example, be an additive or a sorbent. The aerosol-modifying agent may, for example, comprise one or more of a flavorant, a colorant, water, and a carbon adsorbent. The aerosol-modifying agent may, for example, be a solid, a liquid, or a gel. The aerosol-modifying agent may be in powder, thread or granule form. The aerosol-modifying agent may be free from filtration material.

In some embodiments, the substance to be delivered may comprise one or more active constituents, one or more flavors, one or more aerosol-former materials, and/or one or more other functional materials. The one or more other functional materials may comprise one or more of pH regulators, coloring agents, preservatives, binders, fillers, stabilizers, and/or antioxidants.

An aerosol generator is an apparatus configured to cause aerosol to be generated from the aerosol-generating material. In some embodiments, the aerosol generator is a heater configured to subject the aerosol-generating material to heat energy, so as to release one or more volatiles from the aerosol-generating material to form an aerosol. In some embodiments, the aerosol generator is configured to cause an aerosol to be generated from the aerosol-generating material without heating. For example, the aerosol generator may be configured to subject the aerosol-generating material to one or more of vibration, increased pressure, or electrostatic energy. The aerosol generator may be provided as a permanent part of the aerosol provision device.

Apparatus is known that heats aerosol-generating material to volatilize at least one component of the aerosol-generating material, typically to form an aerosol which can be inhaled, without burning or combusting the aerosol-generating material. Such apparatus is sometimes described as an "aerosol generating device", an "aerosol provision device", a "heat-not-burn device", a "tobacco heating product device" or a "tobacco heating device" or similar. Similarly, there are also so-called e-cigarette devices, which typically vaporize an aerosol-generating material in the form of a liquid, which may or may not contain nicotine. The aerosol-generating material may be in the form of or be provided as part of a rod, cartridge or cassette or the like which can be inserted into the apparatus.

A user of an aerosol provision device will store the aerosol provision device in a storage, such as a pocket or a bag, when aerosol is not being drawn through the aerosol provision device. The user will then remove the aerosol provision device from the storage before configuring the aerosol provision device ready for a usage session when aerosol is drawn from the device or the device is cleaned. Interaction by the user with the aerosol provision device comprises physically adjusting the aerosol provision device to a state suitable for the usage session. Aerosol provision devices and aerosol provision systems are described herein, that offer improved setup functionality and/or reduced storage demands.

Figure 1B:
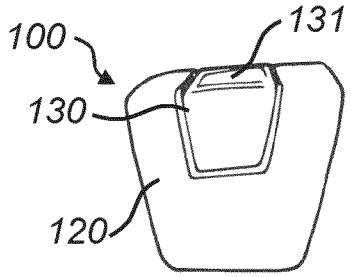
FIG. 1*b* shows a schematic perspective view of the aerosol provision device of FIGS. 1*a* and 1*c*.
Figure 1C:
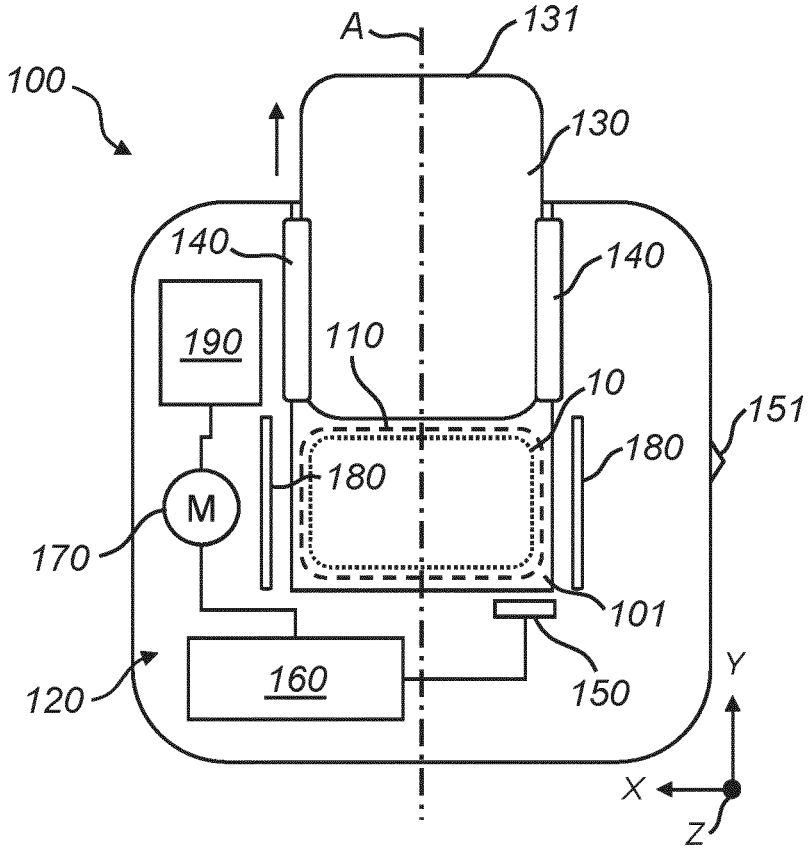
Figure 1D:
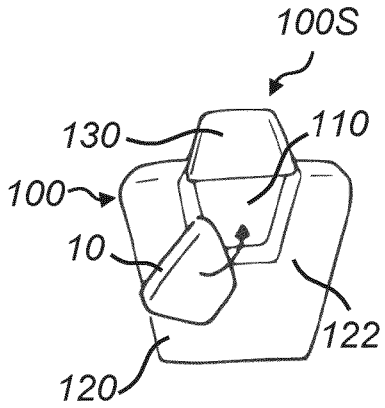
FIG. 1*d* shows a schematic perspective view of an aerosol provision system comprising the aerosol provision device of FIGS. 1*a* and 1*c*.

Referring to FIGS. 1*a*, 1*b*, and 1*c*, an aerosol provision device 100 is shown. Referring to FIG. 1*d*, an aerosol provision system 100S comprising the aerosol provision device 100 is shown.

The aerosol provision device 100 comprises a chamber 110 for receiving a consumable 10 comprising aerosol-generating material. The chamber 110 is formed in a cavity 101 of the aerosol provision device 100. The consumable 10 is configured to occupy part of the cavity 101. The consumable 10 is shown with a dotted boundary in FIG. 1*c* to schematically indicate where the consumable 10 is positioned when the consumable 10 is in the chamber 110. In this embodiment, the chamber 110 is configured so that the consumable 10 abuts walls of the chamber 110, even though a gap between the consumable 10 and the walls is shown.

In some embodiments, the chamber 110 comprises an interface (not shown) configured to engage with the consumable 10 to retain the consumable 10 at a predetermined position in the chamber 110. In this embodiment, the consumable 10 is insertable into the chamber 110 via an opening at a side of the chamber 110. In other embodiments, the consumable 10 may be insertable into the chamber 110 via an opening at an end of the chamber 110.

In this embodiment, the chamber 110 is variable in size and therefore variable in volume. In other embodiments, the chamber 110 may comprise a fixed size and therefore fixed volume. The chamber 110, shown in FIG. 1*a*, is provided in a collapsed state with a minimum size (minimum volume). The chamber 110, shown in FIG. 1*c*, is provided in an expanded state with a maximum size (maximum volume). Advantageously, the aerosol provision device 100 is more compact when the chamber 110 is in the collapsed state, for example when the aerosol provision device 100 is stored by a user of the aerosol provision device 100, than when the chamber 110 is in the expanded state.

When the consumable 10 is in the chamber 110, part of the consumable 10 is visible to a user. The part of the consumable 10 is visible when viewing only one side of the aerosol provision device 100 in a depth direction, shown as direction Z. That is, the chamber 110 is configured to cause the consumable 10 to not be visible to a user when viewing a length (longitudinal) direction and a width (transverse) direction, shown as direction Y and direction X, respectively because the consumable 10 is shielded from view by the aerosol provision device 100. In some embodiments, the chamber 110 may be configured to cause the consumable 10 to protrude from the aerosol provision device 100. Protrusion of the consumable 10 is seen when viewing the aerosol provision device 100 in the longitudinal direction Y and width direction X. In other embodiments, the chamber 110 may be configured to cause the consumable 10 to be concealed, and therefore not visible to the user, when viewing the aerosol provision device 100 in the depth direction Z, when the consumable 10 is in the chamber 110. In other embodiments, the chamber 110 may be configured to cause the consumable 10 to be visible when the aerosol provision device 100 is viewed in a plurality of directions when the consumable 10 is in the chamber 110. In other embodiments, the chamber 110 may be configured to cause the consumable 10 to be entirely concealed when the aerosol provision device 100 is viewed in any direction, and therefore completely invisible to the user, when the consumable 10 is in the chamber 110, unless the aerosol provision device 100, or part of the aerosol provision device 100, is transparent or translucent.

The aerosol provision device 100 comprises an aerosol generator 180 for generating an inhalable medium, such as aerosol, from the aerosol-generating material of the consumable 10 when the consumable 10 is in the chamber 110. The aerosol generator 180 is configured to supply heat to the aerosol-generating material of the consumable 10 to generate the inhalable medium. The aerosol generator 180 therefore comprises an electrical resistance heater. In other embodiments, the aerosol generator 180 may comprise an induction heater or one or more of an electrical resistance heater and an induction heater. In yet other embodiments, pressure could be used to generate an inhalable medium from the consumable. In the embodiment shown in FIGS. 1*a* and 1*b*, the aerosol generator 180 substantially surrounds the chamber 110 along a length of the chamber 110. In other embodiments, the aerosol generator 180 may extend only partially along the chamber and/or may be positioned elsewhere relative to the chamber 110. For example, the aerosol generator 180 may be positioned within the chamber 110.

The supply of power to the electrical resistance heater is provided by a power source 190. In this embodiment, the power source 190 is a rechargeable battery. The rechargeable battery is integral to the aerosol provision device 100. In other embodiments, the power source may be replaceable, such as a replaceable battery. In other embodiments, the power source 190 may be a non-rechargeable battery. The power source 190 is configured to provide electrical power to electronic components of the aerosol provision device 100.

The aerosol provision device 100 comprises a body 120 and a mouthpiece 130 comprising an opening 131 through which aerosol can be drawn through the mouthpiece 130 by a user of the aerosol provision device 100. The body 120 comprises a portion of the chamber 110 and the mouthpiece 130 comprises a wall of the chamber 110. As best shown when chamber 110 is in the expanded state in FIG. 1*c* and the chamber 110 is open to the user, the chamber 110 has five walls: a back wall in the depth direction Z; two opposing side walls in the width direction X; and two opposing walls in the longitudinal direction Y (an upper wall formed by the mouthpiece 130 and a lower wall formed by the body 120). The body 120 therefore comprises four of the five walls and the mouthpiece 130 comprises the other wall (the upper wall). The wall formed by the mouthpiece 130 is moveable in the longitudinal direction Y so as to cause a size of the chamber 110 to vary. That is, an opening of the chamber 110 is covered by the mouthpiece 130 when the chamber 110 is in the collapsed state, as shown in FIG. 1*a*. In this embodiment, when the chamber 110 is in the expanded state and the consumable 10 is in the chamber 110, as demonstrated by FIG. 1*c*, the mouthpiece 130 is configured to abut the consumable 10. In other embodiments, the mouthpiece 130 may not abut the consumable 10 when the chamber 110 is in the expanded state.

Although in this embodiment, there are five walls of the chamber 110, in other embodiments, there may be fewer than five walls but no less than two, wherein the body 120 comprises at least one wall and the mouthpiece 130 comprises at least one wall. In some embodiments, the body 120 and/or the mouthpiece 130 may comprise an arcuate wall of the chamber 110. The arcuate wall may be complementary in shape to a shape of an arcuate consumable 10. In some embodiments, the body 120 may comprise a single wall of the chamber 110 and that single wall may be arcuate.

The mouthpiece 130 is a component through which aerosol, generated from the aerosol-generating material of the consumable 10, can be drawn by the user of the aerosol provision device 100. The user can draw the aerosol through the mouthpiece 130 when the mouthpiece 130 is arranged in an open position and the consumable 10 is in the chamber 110, as shown in FIG. 1*c*. In this embodiment, the mouthpiece 130 is arranged centrally of a longitudinal axis A of the aerosol provision device 100. In other embodiments, the mouthpiece 130 may be offset from the longitudinal axis A.

The mouthpiece 130 is movable relative to the body 120 so that mouthpiece 130 is accessible for inhalation of the aerosol through the mouthpiece 130 by a user. The mouthpiece 130 is movable back-and-forth along the longitudinal axis A. The mouthpiece 130 is therefore a movable component of the aerosol provision device 100. The mouthpiece 130 is also configured to occupy part of the cavity 101 of the aerosol provision device 100 (another part is occupied by the consumable 10, as shown in FIG. 1*c*). The mouthpiece 130 is therefore configured to move within the cavity 101 to open and close the cavity 101. Opening the cavity 101 causes the chamber 110 to increase in size, whereas, closing the cavity 101 causes the chamber 110 to decrease in size.

The mouthpiece 130 is movable between a first position (as shown in FIGS. 1*a* and 1*b*) and a second position (as shown in FIGS. 1*c* and 1*d*). In the first position, a first portion of the mouthpiece 130 that is exposed from the aerosol provision device 100 is smaller than a second portion of the mouthpiece 130 in the second position. The first position is a retracted position because the mouthpiece 130 is retracted in the body 120. The retracted position can be considered a closed position of the mouthpiece 130. The second position is an extended position because the mouthpiece 130 is extended from the body 120. The extended position can be considered an open position of the mouthpiece. In the first position, the chamber 110 has a size that is smaller than when in the second position.

Figure 2A:
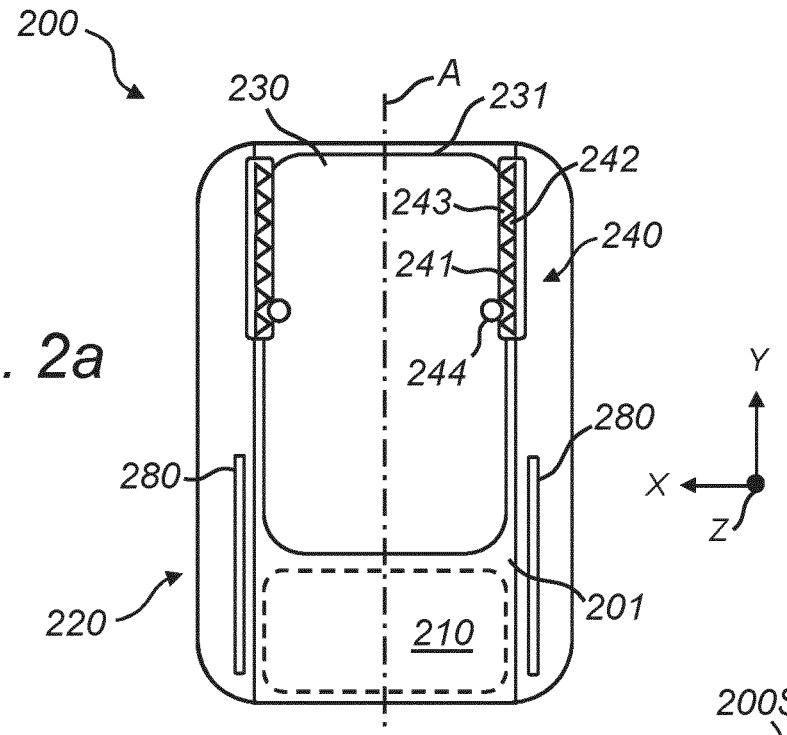
FIGS. 2*a* and 2*b* each show a schematic cross-sectional view of an aerosol provision device.
Figure 2B:
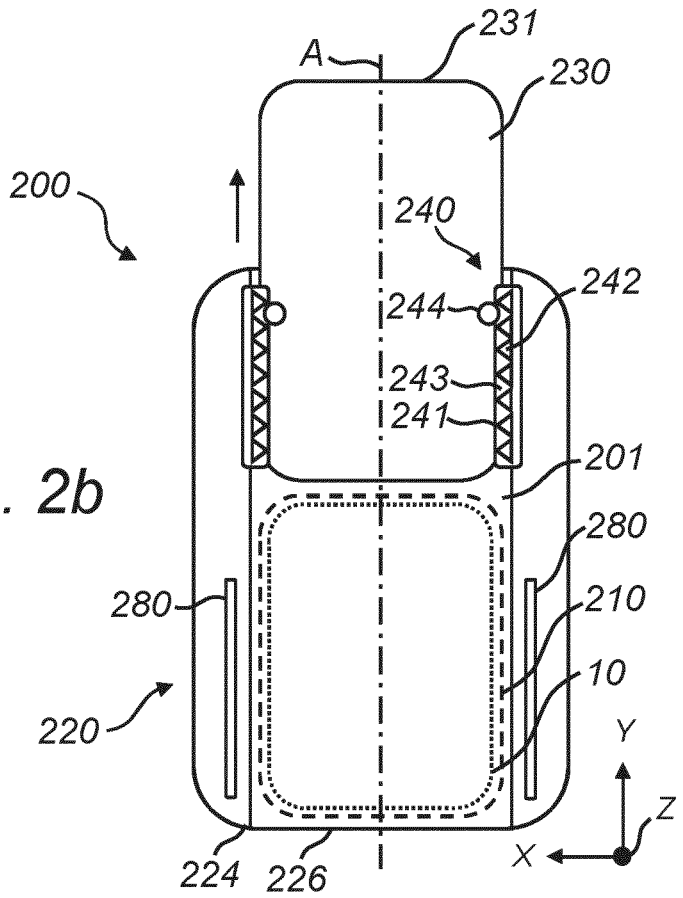

The mouthpiece 130 is configured to allow the chamber 110 to extend in the longitudinal direction Y to a longitudinal extent the aerosol generator 180 as shown in FIG. 1*c*. In the second position, the chamber 110 is an aerosol generation zone. In some embodiments, the chamber 110 is configured to extend in the longitudinal direction Y beyond a longitudinal extent of the aerosol generator 180, as shown in the embodiment of FIGS. 2*a* and 2*b*.

When the consumable 10 is in the chamber 110 and the mouthpiece 130 is in the second position, aerosol generated from the aerosol-generating material can be drawn from the consumable 10. A user is therefore able to draw on the mouthpiece 130 to inhale the aerosol generated by the aerosol provision device 100 when the mouthpiece 130 is in the second, open position. In the first position, the chamber 110 is closed to a user because the cavity 101 is at least partially covered by the mouthpiece 130. That is, the mouthpiece 130 is configured such that, in the first position, the mouthpiece 130 at least partially covers an opening into the chamber 110 through which the consumable 10 is insertable. In the first position, a user is therefore unable to draw on the mouthpiece 130 in the first position. The mouthpiece 130 may be of any suitable shape to at least partially cover the cavity 101 when the mouthpiece 130 is in the first position. In other embodiments, the mouthpiece 130 may entirely cover the cavity 101 when the mouthpiece 130 is in the first position.

When the consumable 10 is removed from the aerosol provision device 100, the mouthpiece 130 is configured to move from the second position to the first position to at least partially cover the cavity 101. In other embodiments, the mouthpiece 130 is unbiased and is configured to be moveable to the first position. During storage of the aerosol provision device 100, the mouthpiece 130, being in the first position, helps to reduce an overall size of the aerosol provision device 100. When in the first position, the mouthpiece 130 reduces a risk of contamination in the cavity 101 and protects a user from residual heat in the chamber 110 that is produced by the aerosol generator 180.

The aerosol provision device 100 comprises a guide 140. The guide 140 is configured to guide movement of the mouthpiece 130 in a predetermined manner between the first, closed position and the second, open position of the mouthpiece 130. The guide 140 is optional, such that, in some embodiments, the mouthpiece 130 may move freely between the first and second positions without guiding movement of the mouthpiece 130. This may allow the mouthpiece 130 to move in a random manner between the first and second positions.

In this embodiment, the guide 140 enables the mouthpiece 130 to slide relative to the body 120 between the first, closed position and the second, open position of the mouthpiece. That is, the mouthpiece 130 is translationally movable the closed position to the open position. In this embodiment, the translational movement is rectilinear. In this embodiment, the guide 140 provides for guided movement of the mouthpiece 130 using frictional surface contact between two substantially flat surfaces. The guide 140 comprises one substantially flat surface and the mouthpiece 130 comprises another substantially flat surface. In this embodiment, an outer surface of the mouthpiece 130 comprises the another substantially flat surface. In some embodiments, the guide 140 and mouthpiece 130 may comprise non-flat surfaces that still provide the frictional surface contact to allow the guide 140 to guide movement of the mouthpiece 130 in a predetermined manner between the first, closed position and the second, open position of the mouthpiece 130.

In some embodiments, the aerosol provision device 100 comprises a biasing member configured to bias the mouthpiece 130 to the first position. The biasing member resists movement of the mouthpiece 130 to the second position. In some embodiments, the aerosol provision device 100 comprises a damper configured to dampen movement of the mouthpiece 130 to the first position. The damper may be active only when the mouthpiece 130 is moving to the second position. An example of a biasing member and an example of a damper is shown in FIG. 3*b* and discussed below. Advantageously, the biasing member and damper provide controlled movement of the mouthpiece 130.

A user configures the aerosol provision device 100 for use by inserting the consumable 10 into the chamber 110 provided in a side 122 of the body 120. In this embodiment, a direction of insertion of the consumable 10 into the chamber 110 is perpendicular to a direction of movement of the mouthpiece 130 between the open and closed positions. In the first position, the mouthpiece 130 blocks access to the chamber 110. The mouthpiece 130 must therefore be moved out of the way to unblock the cavity 101 and provide access to the chamber 110. When doing so, the consumable 10 abuts the mouthpiece 130 which causes the mouthpiece 130 to move relative to the body 120 from the first, closed position and to the second, open position. That is, the movement of the consumable 10 into the chamber 110 results in the mouthpiece 130 moving away from the body 120. Further, a position of the mouthpiece 130 relative to the body 120 is determined by a position of the consumable 10 relative to the body 120. In this embodiment, the guide 140 is configured to resist movement of the mouthpiece 130 to control the movement and avoid inadvertent movement of the mouthpiece 130. The resistance is set so as to be operated by the user without excessive force. In other embodiments, the movement may only be automatic to avoid the need for manual operation.

The aerosol provision device 100 comprises a detector 150 to detect insertion of the consumable 10 into the chamber 110. The aerosol provision device 100 also comprises a controller 160 and a driving mechanism in the form of a motor 170. The controller 160 is configured to receive an output from the detector 150 and cause the motor 170 to drive movement of the mouthpiece 130 relative to the body 120 from the first, closed position to the second, open position. The movement of the mouthpiece 130 is therefore on the basis of the output from the detector 150. The detector 150, the controller 160, the motor 170, and the aerosol generator 180 are each powered by the power source 190. Withdrawal of the consumable 10 from the chamber 110, which leads to an absence of the consumable from the aerosol provision device 100, is also detectable by the detector 150. Therefore, removing the consumable 10 from the chamber 110 is also configured to cause movement of the mouthpiece 130 in reverse. That is, the controller 160 is configured to receive an output from the detector 150 to detect an absence of the consumable 10 in chamber 110 and cause the motor 170 to drive movement of the mouthpiece 130 relative to the body 120 from the second, open position to the first, closed position. In this embodiment, a user can operate a switch 151 to turn the detector 150 on or off. The switch 151 is manually operable and is configured to send an electronic signal to the controller 160 to allow the detector 150 to be enabled or disabled. In this embodiment, the switch 151 is a push switch. In other embodiments, the switch 151 is a sliding switch. In some embodiments, the switch 151 does not require movement to be imparted by the user on the switch 151 to operate the switch 151. For example, the switch 151 may comprise capacitive sensing to sense a presence of the user. When the detector 150 is turned off, the mouthpiece 130 moves by manual insertion of the consumable 10. When the detector 150 is turned on, the mouthpiece 130 moves automatically when insertion of the consumable 10 is detected.

In some embodiments, the controller 160 may be configured to activate the aerosol generator 180 once the detector 150 has detected the presence of the consumable 10 in the chamber 110. In some embodiments, activation of the aerosol generator 180 by the controller 160 is immediate. In other embodiments, activation of the aerosol generator 180 by the controller 160 is delayed by a predetermined time.

Figure 2C:
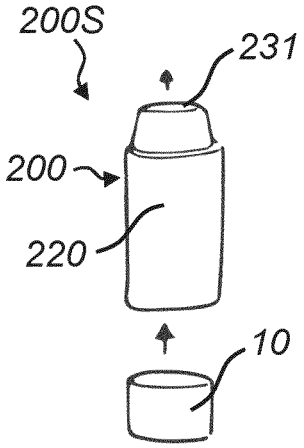
FIG. 2*c* shows a schematic perspective view of an aerosol provision system comprising the aerosol provision device of FIGS. 2*a* and 2*b*.

FIGS. 2*a* and 2*b* show an aerosol provision device 200 and FIG. 2*c* shows an aerosol provision system 200S comprising the aerosol provision device 200. The aerosol provision device 200 and the aerosol provision system 200S are substantially similar to the aerosol provision device 100 and aerosol provision system 100S, respectively, as described with reference to FIGS. 1*a*, 1*b*, and 1*c*. Similar components in the aerosol provision device 200 and the aerosol provision system 200S have the same reference numbers as those of FIGS. 1*a*, 1*b*, and 1*c* but the reference numbers are increased by 100. Although not shown, the aerosol provision device 200 comprises a power source, and a controller as discussed in relation to the aerosol provision device 100 of FIGS. 1*a*, 1*b*, and 1*c*.

In this embodiment, a mouthpiece 230 is completely retractable in a cavity 201 of the aerosol provision device 200, as shown in FIG. 2*a*. A mouthpiece 230 that is completely retractable is advantageous because the aerosol provision device 200 is more compact when the mouthpiece 230 is arranged in the first position. Further, when the mouthpiece 230 is arranged in the first position, the mouthpiece 230 is concealed by a body 220 when viewing the aerosol provision device 200 in the depth direction Z.

The mouthpiece 230, in this embodiment, is manually movable between the first position, shown in FIG. 2*a*, and the second position, shown in FIG. 2*b*. Although motorized operation by a motor, as discussed in relation to aerosol position device 100, is not shown, this could be provided in the aerosol position device 200. Such manual configuration may help to decrease the complexity of the aerosol position device 200 because the mouthpiece 230 can move directly by user force on the mouthpiece 230.

The movement of the mouthpiece 230 in the aerosol position device 200 is guided by a guide 240. The guide 240 of this embodiment enables the mouthpiece 230 to slide relative to the body 220 between the first, closed position and the second, open position, as discussed with aerosol provision device 100. However, the guide 240 of this embodiment is different to that of the aerosol provision device 100 in that the guide 240 comprises a track 242 and a runner 244. The runner 244 is configured to move along the track 242. The track 242 and the runner 244 provide guided movement beyond what is provided by frictional surface contact between two substantially flat surfaces, as described in relation to aerosol provision device 100. In this embodiment, the mouthpiece 230 comprises the runner 244 and the body 220 comprises the track 242. In other embodiments, the mouthpiece 230 may comprise the track 242 and the body 220 may comprise the runner 244.

As shown in FIGS. 2*a* and 2*b*, the track 242 comprises a series of undulations and the runner 244 is a ball that moves along the undulations. The ball is an example of a detent that is biased towards the runner 244, by a biasing member (not shown but similar to other biasing members described herein), to latch the mouthpiece 230 in a predetermined position. In other embodiments, the runner 244 may comprise a flexible member that is biased towards the track 242. In such an embodiment, the guide 240 may comprise a snap fit mechanism, wherein the snap-fit mechanism comprises the flexible member and the track 242.

In this embodiment, the track 242 comprises seven protrusions 241 and six grooves 243 therebetween. Each groove 243 is a discrete interval to hold a position of the mouthpiece 230 relative to the body 220. When the runner 244 is a flexible member and the guide is a snap-fit mechanism, the flexible member may be configured to snap in and out of the grooves due to the bias of the flexible member towards the track 242.

In this embodiment, when the mouthpiece 230 is in the first position, as shown in FIG. 2*a*, the runner 244 is in one extreme end of the six grooves 243. In the second position of the mouthpiece 230, as shown in FIG. 2*b*, the runner 244 is in another extreme end of the six grooves 243. Each groove 243 between the extreme ends of the grooves 243 corresponds to a different one of a number of predetermined positions of the mouthpiece 230. The number of predetermined positions in this embodiment is four. In other embodiments, the number of predetermined positions may be greater or fewer than four.

A user inserts a consumable 10 through an opening 226 at an end 224 of the body 220 and into a chamber 210. As the consumable 10 is further inserted, the user imparts a force on the mouthpiece 230 by the consumable 10 to move the mouthpiece 230 along the longitudinal axis A of the aerosol provision device 200 from the first position shown in FIG. 2*a* to the second position shown in FIG. 2*b*. Any resistance provided by the guide 240 would need to be overcome to move the mouthpiece 230. In this embodiment, a direction of insertion of the consumable 10 into the chamber 210 is the same as a direction of movement of the mouthpiece 230 from the closed position to the open position.

In this embodiment, the movement of the mouthpiece 230 comprises a discrete number of steps because of the discrete intervals provided by the track 244. Nevertheless, it is the movement of the consumable 10 towards and into the chamber 210 that causes the mouthpiece 230 to move relative to the body 220 from the retracted (closed) position to the extended (open) position. In the extended position, the user can draw aerosol generated from the aerosol-generating material of the consumable 10 through an opening 231 of the mouthpiece 230.

In this embodiment, a direction of extension of the mouthpiece 230 corresponds to a direction of a majority dimension of the aerosol provision device 200. In this embodiment, the majority dimension is a length of the aerosol provision device 200 as shown in direction Y.

Once the consumable 10 is fully inserted into the chamber 210, as shown in FIG. 2*b*, the consumable is concealed by the body 220 when viewing the aerosol provision device 200 in a depth direction Z. The consumable 10 is concealed by a longitudinal end 224 of the body 220. Although the mouthpiece 230 is extended from the body 220 in the second position, to increase an overall size of the aerosol provision device 200, the consumable 10 itself does not further impact the overall size. Although the consumable 10 is concealed in the depth direction, when the consumable 10 is fully inserted into the chamber 210, the consumable 10 is still visible to the user when looking at the longitudinal end 224 of the aerosol provision device 200. In other embodiments, the longitudinal end 224 of the aerosol provision device 200 may be covered by a cover (not shown) to entirely conceal the consumable 10 in the chamber 210.

In this embodiment, the chamber 210 is also variable in size. However, in the first position of the mouthpiece 230, shown in FIG. 2*a*, the chamber 210 occupies approximately half of the length of the aerosol generator 280 in a longitudinal direction Y of the aerosol provision device 200. This may allow for improved cooling of the chamber 210 when a consumable 10 has been heated by the aerosol generator 280 because a portion of the cavity 201 that would be for occupancy by the consumable 10 is open to atmosphere.

Figure 3A:
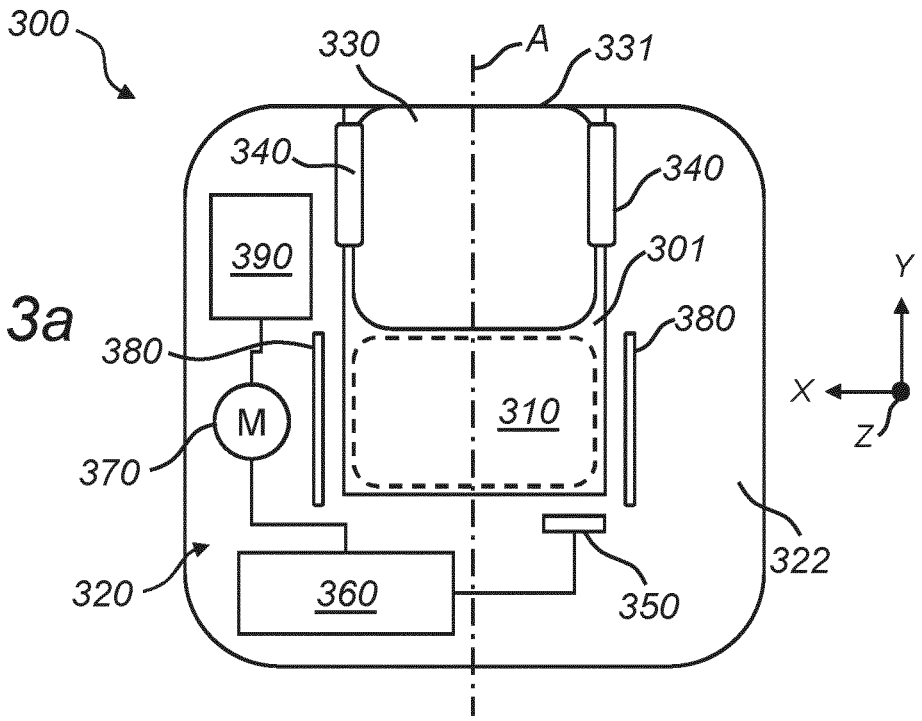
FIGS. 3*a* and 3*b* each show a schematic cross-sectional view of an aerosol provision device.
Figure 3B:
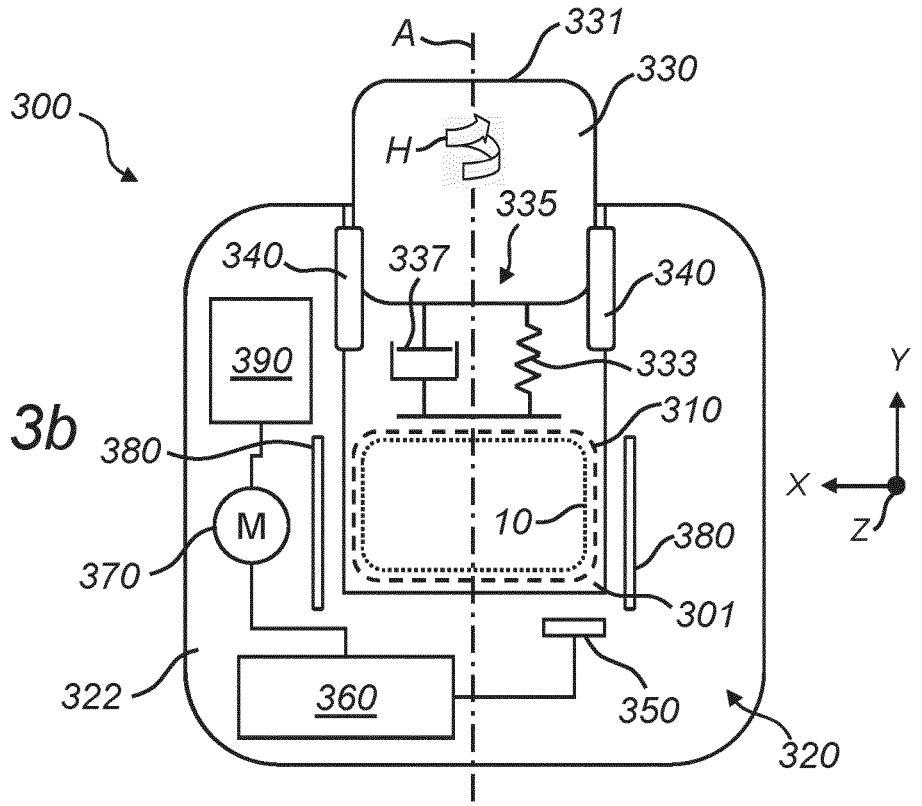

FIGS. 3*a* and 3*b* show an aerosol provision device 300. The aerosol provision device 300 is a variation of the aerosol provision device 100 described with reference to FIGS. 1*a*, 1*b*, and 1*c*. Similar components in the aerosol provision device 300 have the same reference numbers as those of FIGS. 1*a*, 1*b*, and 1*c* but the reference numbers are increased by 200. Such common features are not discussed again. The discussion below is limited to the differences between the aerosol provision devices 100, 300.

One difference between the aerosol provision device 100, as previously described in relation to FIGS. 1*a*, 1*b*, and 1*c*, and the aerosol provision device 300 according to this embodiment, and shown in FIGS. 3*a* and 3*b*, is that a chamber 310 of the aerosol provision device 300 comprises a fixed size (and therefore a fixed volume). That is, in the first position of a mouthpiece 330, shown in FIG. 3*a*, the chamber 310 occupies the same amount of space in a cavity 301 as the chamber 310 occupies the space of the cavity 301 when the mouthpiece 330 is in the second position, shown in FIG. 3*b*. When the mouthpiece 330 is in the retracted position, the chamber 310 is also exposed to atmosphere because the chamber 310 is open to one side 322 of a body 320 of the aerosol provision device 300. This may allow for improved cooling of the chamber 310 when a consumable 10 has been heated by an aerosol generator 380 because a portion of the cavity 301 that is for occupancy by the consumable 10 is open to the external environment when the consumable 10 is removed.

The aerosol provision device 300 comprises a damping mechanism 335 configured to control movement of the mouthpiece 330 from the closed position of the mouthpiece 330, as shown in FIG. 3*a*, to the open position of the mouthpiece 330, as shown in FIG. 3*b*. The damping mechanism 335 comprises a biasing member 333 and a damper 337. In some embodiments, the damping mechanism 335 may comprise only one of the biasing member 333 or damper 337. The biasing member 333 is configured to bias the mouthpiece 330 to the first position and the damper is configured to control a speed at which the mouthpiece 330 moves, to dampen movement of the mouthpiece 330 to the first position. The biasing member 333 resists movement of the mouthpiece 330 to the second position. Advantageously, the biasing member 333 and damper 337 provide controlled movement of the mouthpiece 330 along a guide 340.

In this embodiment, the mouthpiece 350 moves by operation of a motor 370. The motor 370 is driven by a controller 360 following an output from a detector 350 detecting presence of the consumable 10 in the chamber 310. The aerosol provision device 300 does not comprise a switch to engage and disengage operation of the motor 370 by enabling or disabling the detector 350, as described in relation to aerosol provision device 100. This is because operation of the motor 370 is automatic when the detector 350 has detected the presence of the consumable 10 in the aerosol provision device 300.

In this embodiment, the mouthpiece 330 is helically rotatable about a longitudinal axis A of the aerosol provision device 300. That is, the mouthpiece 350 moves helically along the guide 340 so that the mouthpiece 330 retracts and extends from the body 320 in the longitudinal direction Y. Put another way, the mouthpiece 350 is configured to move along a helical path, as shown by a helical arrow H in FIG. 3*b*, when the mouthpiece 350 moves between the closed position and the open position. In this embodiment the mouthpiece 350 and the guide 340 comprise respective threaded portions (not shown) that engage with each other to determine the helical path. Although in this embodiment, movement of the mouthpiece 330 along the helical path is continuous, in other embodiments, the movement of the mouthpiece 330 along the helical path may be discrete.

Figure 4A:
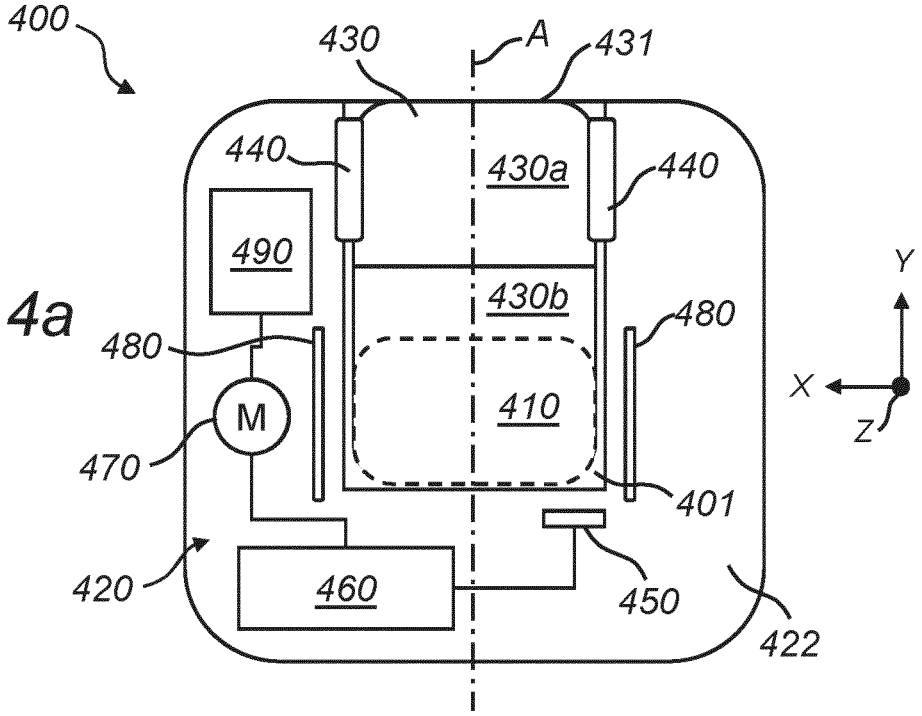
FIGS. 4*a* and 4*b* each show a schematic cross-sectional view of an aerosol provision device.
Figure 4B:
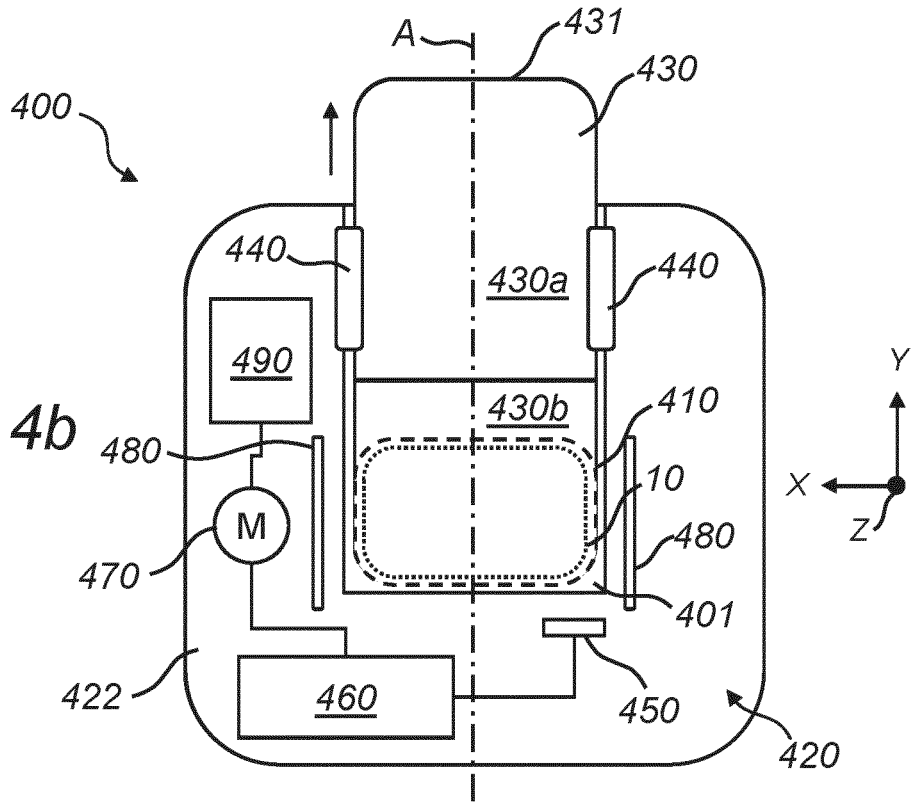
Figure 5A:
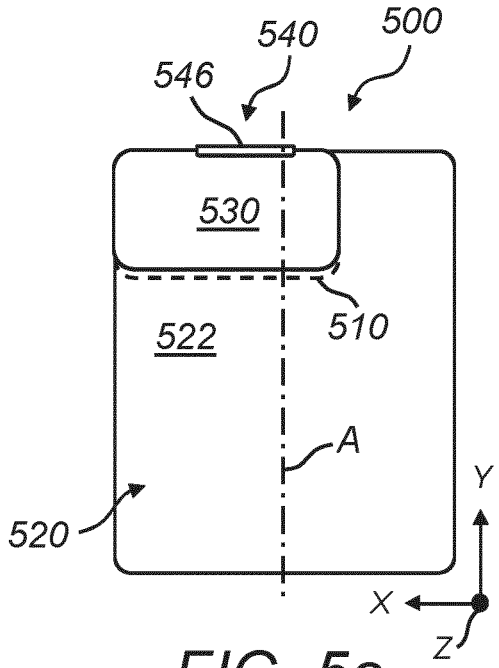
FIGS. 5*a* and 5*b* each show a schematic cross-sectional view of an aerosol provision device.
Figure 5B:
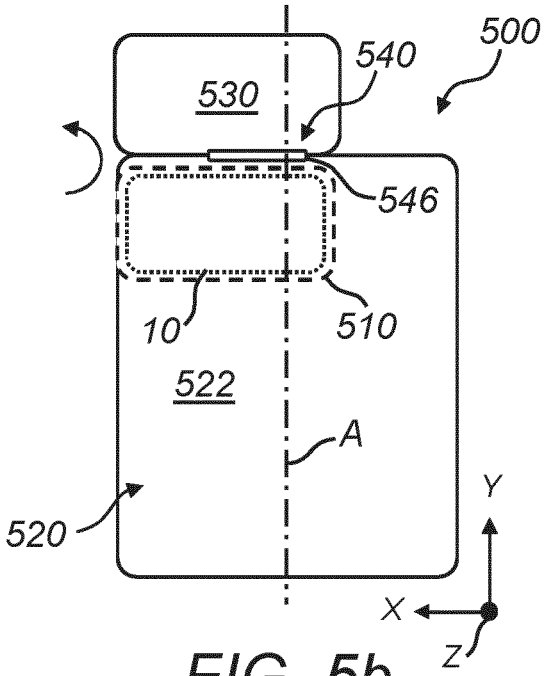
Figure 6A:
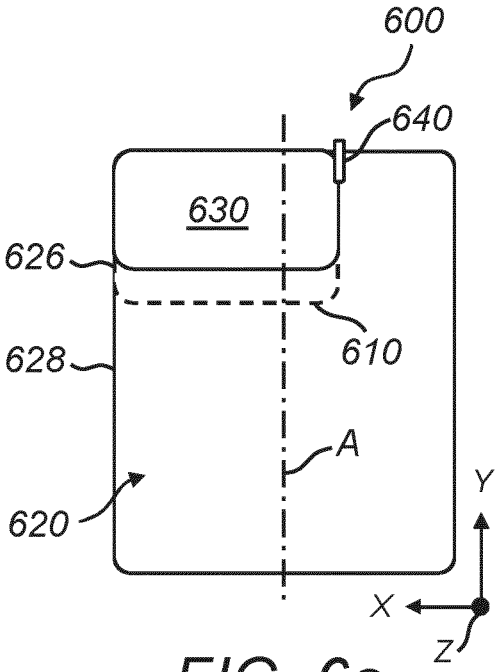
FIGS. 6*a* and 6*b* each show a schematic cross-sectional view of an aerosol provision device.
Figure 6B:
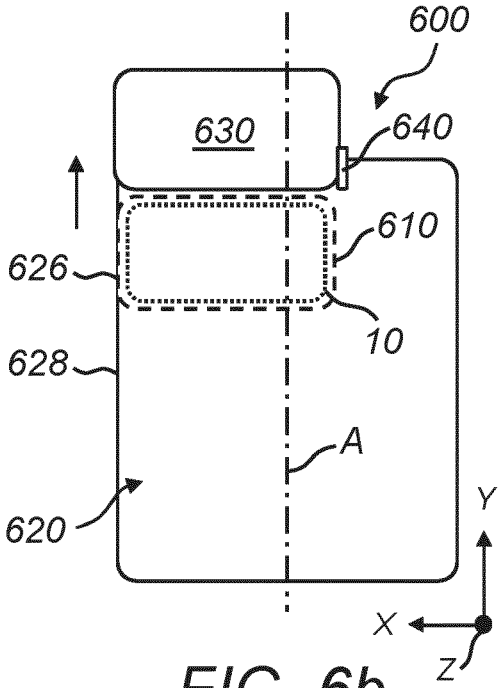

FIGS. 4*a* and 4*b* show an aerosol provision device 400. The aerosol provision device 400 is a variation of the aerosol provision device 100 described with reference to FIGS. 1*a*, 1*b*, and 1*c*. Similar components in the aerosol provision device 400 have the same reference numbers as those of FIGS. 1*a*, 1*b*, and 1*c* but the reference numbers are increased by 300. Such common features are not discussed again and the discussed below is limited to the differences between the aerosol provision devices 100, 400.

One difference between the aerosol provision device 100, as previously described in relation to FIGS. 1*a*, 1*b*, and 1*c*, and the aerosol provision device 400 according to this embodiment, and shown in FIGS. 4*a* and 4*b*, is that a chamber 410 of the aerosol provision device 400 comprises a fixed size (and therefore a fixed volume) as discussed in relation to aerosol provision device 300. This means that the chamber 410 comprises the same volume when a mouthpiece 430 is in the first and second positions, as shown in FIGS. 4*a* and 4*b*, respectively.

The mouthpiece 430 of this embodiment is telescopic and comprises a first part 430*a* of the mouthpiece that is movable relative to a second part 430*b* of the mouthpiece. The guide 440 is to provide guided movement of only one of the first part 430*a* and the second part 430*b*. In this embodiment, the guide 440 provides guided movement of the first part 430*a* only. In other embodiments, the guide 440 may provide guided movement of both parts 430*a*, 430*b*. As the mouthpiece 430 moves to the extended position shown in FIG. 4*b*, the first part 430*a* extends from a body 420 and moves with respect to the chamber 410. During such movement, the chamber 410 is fixed relative to the second part 430*b* because the chamber 410 is provided in the second part 430*b*. In this embodiment, walls of the chamber 410 are entirely formed by the second part 430*b* of the mouthpiece 430. Although the mouthpiece 430 is provided with a cavity 401, walls of the chamber 410 are not formed by walls of the cavity 401.

In this embodiment, the second part 430*b* of the mouthpiece comprises the chamber 410. That is, the chamber 410 is unblocked, and open to atmosphere, when the mouthpiece 430 is in the closed position, shown in FIG. 4*a*. That is, when the mouthpiece 430 is in the retracted position, the chamber 410 is also exposed to atmosphere because the chamber 410 is open to one side 422 of the body 420 of the aerosol provision device 300. This may allow for improved cooling of the chamber 410 when a consumable 10 has been heated by the aerosol generator 480 because chamber 410 is open to the external environment when the consumable 10 is removed.

Similarly, to aerosol provision device 300, in this embodiment, the mouthpiece 450 moves by operation of a motor 470. The motor 470 is driven by a controller 460 following an output from a detector 450 detecting presence of the consumable 10 in the chamber 410. Also, the aerosol provision device 400 does not comprise a switch to engage and disengage operation of the motor 470 by enabling or disabling the detector 450, as described in relation to aerosol provision device 100. This is because operation of the motor 470 is automatic in aerosol provision device 400, as explained in relation to aerosol provision device 300. One difference between aerosol provision device 300 and aerosol provision device 400 is that the detector 450 is configured to also detect movement of the consumable towards the chamber 410 so that the mouthpiece 430 is able to move before the consumable 10 enters the chamber 410. This improves a speed of configuration of the aerosol provision device 400 so that the user is able to draw on the aerosol provision device 400 sooner.

FIGS. 5*a*, 5*b*, 6*a*, and 6*b* show aerosol provision devices 500, 600. As discussed previously, similar components in the aerosol provision devices 500, 600 have the same reference numbers as those of FIGS. 1*a*, 1*b*, and 1*c* but the reference numbers are increased by 400, 500, respectively. Such common features are not discussed again. The discussion below is limited to the differences.

The aerosol provision devices 500, 600 may also comprise features discussed previously that are compatible with the aerosol provision devices 500, 600 but are not shown in FIG. 5*a*, 5*b*, 6*a*, or 6*b*. Examples include a damping mechanism, a detector, a controller, a motor, an aerosol generator, and a power source.

Each of aerosol provision devices 500, 600 comprises a mouthpiece 530, 630 that is offset from a longitudinal axis A of the respective aerosol provision device 500, 600. Although the mouthpieces 530, 630 extend in a longitudinal direction Y, the mouthpieces 530, 630 are provided in a corner of the respective aerosol provision device 500, 600. Furthermore, a direction of insertion of a consumable 10 into each chamber 510, 610 of the respective aerosol provision devices 500, 600 is different to a direction of movement of the respective mouthpiece 530, 630 between the open and closed positions In aerosol provision device 500, the mouthpiece 530 is configured to rotate about a pivot 546. A guide 540 comprises the pivot 546. The pivot 546 guides rotational movement of the mouthpiece 530 relative to a body 520 when the consumable 10 is inserted into the chamber 510. The consumable 10 is insertable in the side 522 of the body 520 to force the mouthpiece 530 away from the first position, shown in FIG. 5*a*, and towards the second position, shown in FIG. 5*b*. When the consumable 10 is removed, the mouthpiece 530 is then manually rotated back by a user from the second position to the first position. In some embodiments, the mouthpiece 530 may latch into one or both of the first and second positions. In this embodiment, the pivot 546 rotates about a width direction X such that an axis of the pivot 546 is provided in the width direction X and is perpendicular to a longitudinal axis A of the aerosol provision device 500. In other embodiments, the axis of the pivot 546 may be provided in an oblique direction to the longitudinal axis A of the aerosol provision device 500. In other embodiments, the pivot 546 may rotate about a length direction Y or a depth direction Z such that the axis of the pivot 546 is provided in the length direction Y or the depth direction Z, respectively. In some embodiments, the guide 540 may be a hinge comprising the pivot 546. The hinge may be of any suitable form. In some embodiments, the pivot 546 may comprise a rod, pin or an axle.

In aerosol provision device 600, the mouthpiece 630 is configured to slide along a guide 640. The guide 640 operates in the same manner as described by the guide 140 in relation to FIGS. 1*a* and 1*c*, except that the guide 640 of this embodiment is provided on a single side of the mouthpiece 630. The guide 640 guides translational movement of the mouthpiece 630 relative to a body 620 when a consumable 10 is inserted into the chamber 610. In this embodiment, the consumable 10 is inserted into the chamber 610 in a width direction X through an opening 626 in a transverse side 628 of the body 620. As the consumable 10 is inserted into the transverse side 628 of the body 620, the consumable 10 forces the mouthpiece 630 away from the first position, shown in FIG. 6*a*, and towards the second position, shown in FIG. 6*b*. In this embodiment, the guide 640 provides guided movement in a direction parallel to a longitudinal axis A of the aerosol provision device 600. In other embodiments, the guide 640 may provide guided movement in an oblique direction to the longitudinal axis A of the aerosol provision device 600.

Figure 7:
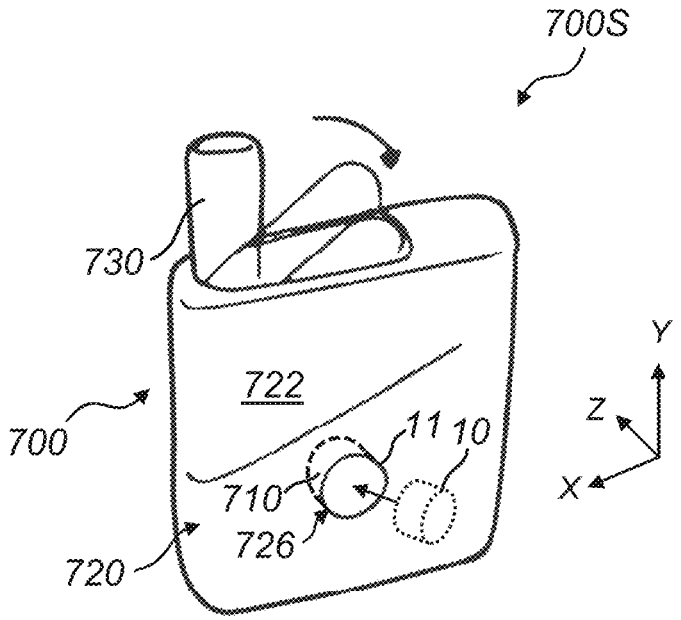
FIG. 7 shows a schematic perspective view of an aerosol provision system.

FIG. 7 shows an aerosol provision system 700S comprising an aerosol provision device 700 and a consumable 10 for insertion in the aerosol provision device 700. An inserted consumable 11 is shown with a solid line boundary and a non-inserted consumable 10 is shown with a dotted boundary. The dashed line indicates a chamber 710 into which the non-inserted consumable 10 is to be inserted and the inserted consumable 11 has already been inserted. As discussed previously, similar components in the aerosol provision device 700 have the same reference numbers as those of FIGS. 1*a*, 1*b*, and 1*c* but the reference numbers are increased by 600. Such common features are not discussed again. The discussion below is limited to the differences.

The aerosol provision device 700 may comprise features discussed previously that are compatible with the aerosol provision device 700 but are not shown in FIG. 7. Examples include a damping mechanism, a detector, a controller, a motor, an aerosol generator, and a power source.

The aerosol provision device 700 comprises an opening 726 in a side 722 of the aerosol provision device 700. The opening 726 provides access to a chamber 710 in a body 720 of the aerosol provision device 700 for receiving a non-inserted consumable 10. The chamber 710 is visible when the consumable 10, 11 is absent the chamber 710 and a user is viewing the side 722 of the aerosol provision device 700 in a depth direction of the aerosol provision device 700. The inserted consumable 11 is visible to a user but does not protrude from the side 722 the aerosol provision device 700.

The aerosol provision device 700 comprises a detector (not shown in FIG. 7) as described in relation to aerosol provision device 100. The detector detects insertion of the consumable 10, 11 into the chamber 710 which causes a mouthpiece 730 to move from a first, closed position to a second, open position by controlled operation of a driving mechanism (not shown in FIG. 7) in the form of a motor (not shown in FIG. 7). Any aspect as previously described in relation to this operation of aerosol provision device 100 also applies to aerosol provision device 700, except for a direction of movement of the mouthpiece 730.

In aerosol provision device 700, the mouthpiece 730 pivots relative to the body 720 as shown in FIG. 7. The axis of the pivot is offset from a longitudinal center of the aerosol provision device 700 such that when the mouthpiece 730 is rotated by pivoting about the axis, the mouthpiece 730 extends from the body 720 to one side of the body 720. In this embodiment, the axis of the pivot is in a depth direction Z and is therefore perpendicular to a longitudinal direction Y of the aerosol provision device 700.

Although not shown, any of the aerosol provision devices 100, 200, 300, 400, 500, 600, 700 may comprise a retention member to hold the consumable 10 in position in the respective chamber 110, 210, 310, 410, 510, 610, 710. The retention member may help to prevent unintentional movement of the consumable 10. Alternatively, or additionally, a retention member may be provided to hold the respective mouthpiece 130, 230, 430, 530, 630, 730 in one or both of the first and second positions. An example retention member is a protrusion of the body 120, 220, 320, 420, 520, 620, 720 that is engageable with a recess of the respective mouthpiece 130, 230, 430, 530, 630, 730 and/or consumable 10. Cooperation of the protrusion and recess may increase the force necessary to remove the mouthpiece 130, 230, 430, 530, 630, 730 from the first and/or second position or the consumable 10 from the respective chamber 110, 210, 310, 410, 510, 610, 710. This may help to prevent unintentional movement of the mouthpiece 130, 230, 430, 530, 630, 730 and/or removal of the consumable 10. In some embodiments, the retention member may be provided on the mouthpiece 130, 230, 430, 530, 630, 730 and/or consumable 10 when the recess is provided in the respective body 120, 220, 320, 420, 520, 620, 720. The retention member could also take the form of a magnetic attachment or an alternative mechanical fastening, such as a screw thread and threaded barrel.

Figure 8:
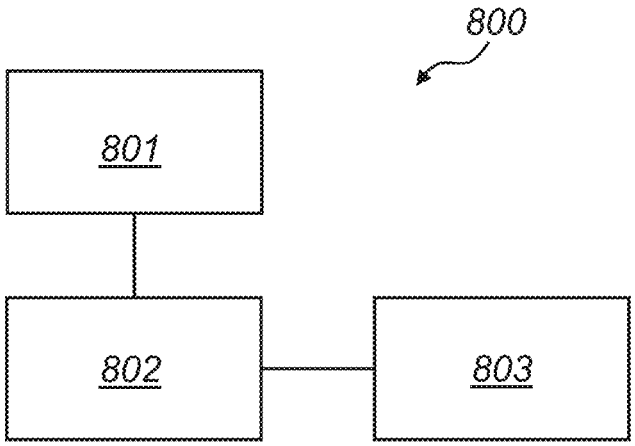
FIG. 8 shows an illustration of a method of arranging an aerosol provision device.

FIG. 8 shows an illustration of a method 800 of arranging an aerosol provision device. The method 800 comprises providing 801 a mouthpiece of the aerosol provision device in a position away from an open position, wherein aerosol generated from the aerosol-generating material can be drawn through the mouthpiece by a user of the aerosol provision device. The method 800 comprises inserting 802 a consumable into the aerosol provision device. The method 800 comprises causing 803, by the inserting, the mouthpiece to move relative to the body to the open position so that the aerosol can be drawn through the mouthpiece by the user.

The aerosol provision devices 100, 200, 300, 400, 500, 600, 700 as previously described, can be used, where discussed, in the operation of the method 800. Furthermore, the causing 803, by the inserting, the mouthpiece to move relative to the body to the open position so that the aerosol can be drawn through the mouthpiece by the user, may be electronically or electro-mechanically operated by a controller.

Embodiments comprise aerosol provision devices 100, 200, 300, 400, 500, 600, 700, aerosol provision systems 100S, 200S, 700S comprising an aerosol provision device 100, 200, 700 and a consumable 10 comprising aerosol-generating material, and a method 800 of arranging an aerosol provision device. The consumable 10 is for receipt in the chamber 110, 210, 310, 410, 510, 610, 710 of the aerosol provision device 100, 200, 300, 400, 500, 600, 700. In use, the aerosol provision device 100, 200, 300, 400, 600, 700 is configured to generate an inhalable medium, such as aerosol, from the aerosol-generating material.

For the avoidance of doubt, where in this specification the term "comprises" is used in defining the invention or features of the invention, embodiments are also disclosed in which the invention or feature can be defined using the terms "consists essentially of" or "consists of" in place of "comprises". Reference to a material "comprising" certain features means that those features are included in, contained in, or held within the material.

The above embodiments are to be understood as illustrative examples of the invention. It is to be understood that any feature described in relation to any one embodiment may be used alone, or in combination with other features described, and may also be used in combination with one or more features of any other of the embodiments, or any combination of any other of the embodiments. Furthermore, equivalents and modifications not described above may also be employed without departing from the scope of the invention, which is defined in the accompanying claims.

The various embodiments described herein are presented only to assist in understanding and teaching the claimed features. These embodiments are provided as a representative sample of embodiments only and are not exhaustive and/or exclusive. It is to be understood that advantages, embodiments, examples, functions, features, structures, and/or other aspects described herein are not to be considered limitations on the scope of the disclosure as defined by the claims or limitations on equivalents to the claims, and that other embodiments may be utilized, and modifications may be made without departing from the scope of the claims. Various embodiments of the disclosure may suitably comprise, consist of, or consist essentially of, appropriate combinations of the disclosed elements, components, features, parts, steps, means, etc., other than those specifically described herein. In addition, this disclosure may include other inventions not presently claimed, but which may be claimed in future.

The invention claimed is:

1. An aerosol provision device comprising:

a chamber configured to receive a consumable comprising aerosol-generating material;

a body; and a mouthpiece through which aerosol generated from the aerosol-generating material is drawn by a user of the aerosol provision device when the mouthpiece is arranged in an open position;

wherein the aerosol provision device is configured so that movement of the consumable towards or into the chamber causes the mouthpiece to move relative to the body from a closed position to the open position.

2. The aerosol provision device according to claim 1, wherein the mouthpiece comprises a wall of the chamber.

3. The aerosol provision device according to claim 1, wherein the body comprises at least a portion of the chamber.

4. The aerosol provision device according to claim 1, wherein, in the closed position, the mouthpiece is retracted in the body.

5. The aerosol provision device according to claim 1, wherein, in the open position, the mouthpiece is extended from the body.

6. The aerosol provision device according to claim 1, wherein the chamber is at least partially unblocked when the mouthpiece is in the closed position.

7. The aerosol provision device according to claim 1, wherein a size of the chamber is the same when the mouthpiece is in the closed position and the open position.

8. The aerosol provision device according to claim 1, wherein a size of the chamber is different when the mouthpiece is in the closed position compared to when the mouthpiece is in the open position.

9. The aerosol provision device according to claim 8, wherein the mouthpiece is configured to occupy at least a portion of the chamber in the closed position and block access to the chamber by the consumable.

10. The aerosol provision device according to claim 1, wherein the aerosol provision device is configured so that insertion of the consumable towards or into the chamber causes the mouthpiece to move relative to the body.

11. The aerosol provision device according to claim 1, wherein a position of the mouthpiece relative to the body is determined by a position of the consumable relative to the body.

12. The aerosol provision device according to claim 1, wherein the mouthpiece is rotatable from the closed position to the open position.

13. The aerosol provision device according to claim 1, wherein the mouthpiece is translationally moveable from the closed position to the open position.

14. The aerosol provision device according to claim 1, wherein the aerosol provision device comprises a guide configured to guide movement of the mouthpiece in a predetermined manner between the open position and the closed position.

15. The aerosol provision device according to claim 1, comprising a detector to detect insertion of the consumable into or towards the chamber, and a controller to receive an output from the detector and cause the mouthpiece to move relative the body from the closed position to the open position on the basis of the output.

16. The aerosol provision device according to claim 1, wherein the aerosol provision device comprises a driving mechanism configured to drive movement of the mouthpiece from the closed position to the open position.

17. The aerosol provision device according to claim 1, wherein the aerosol provision device comprises a damping mechanism configured to control at least a portion of movement of the mouthpiece from the closed position to the open position.

18. The aerosol provision device according to claim 1, wherein the aerosol provision device is arranged such that, when the consumable is located in the chamber, the consumable is visible to the user when looking at a side of the aerosol provision device.

* * * * *